US011199201B2

(12) United States Patent
Makino et al.

(10) Patent No.: US 11,199,201 B2
(45) Date of Patent: Dec. 14, 2021

(54) IMPELLER BACK SURFACE COOLING STRUCTURE AND SUPERCHARGER

(71) Applicant: MITSUBISHI HEAVY INDUSTRIES, LTD., Tokyo (JP)

(72) Inventors: Satoshi Makino, Nagasaki (JP); Koichi Sugimoto, Tokyo (JP); Fumito Hiratani, Tokyo (JP); Yukihiro Iwasa, Nagasaki (JP); Yoshihisa Ono, Nagasaki (JP)

(73) Assignee: MITSUBISHI HEAVY INDUSTRIES MARINE MACHINERY & EQUIPMENT CO., LTD., Nagasaki (JP)

( * ) Notice: Subject to any disclaimer, the term of this patent is extended or adjusted under 35 U.S.C. 154(b) by 86 days.

(21) Appl. No.: 15/745,504

(22) PCT Filed: Jan. 18, 2017

(86) PCT No.: PCT/JP2017/001484
§ 371 (c)(1),
(2) Date: Jan. 17, 2018

(87) PCT Pub. No.: WO2017/145581
PCT Pub. Date: Aug. 31, 2017

(65) Prior Publication Data

US 2018/0216633 A1 Aug. 2, 2018

(30) Foreign Application Priority Data

Feb. 22, 2016 (JP) ..... JP2016-031339

(51) Int. Cl.
*F04D 29/58* (2006.01)
*F02B 39/00* (2006.01)
(Continued)

(52) U.S. Cl.
CPC ..... *F04D 29/584* (2013.01); *F01D 25/12* (2013.01); *F02B 39/00* (2013.01); *F02B 39/005* (2013.01);
(Continued)

(58) Field of Classification Search
CPC ..... F04D 29/584; F04D 29/4206; F04D 29/5853; F04D 29/441; F02B 39/005;
(Continued)

(56) References Cited

U.S. PATENT DOCUMENTS 2,159,422 A * 5/1939 Buchi ..... F02B 39/005 416/93 R
2,184,197 A * 12/1939 Schutte ..... F02C 6/12 417/373

(Continued)

FOREIGN PATENT DOCUMENTS

CN 1908401 A 2/2007
CN 1912363 A 2/2007

(Continued)

OTHER PUBLICATIONS

Office Action dated May 1, 2018, issued in counterpart Korean application No. 10-2017-7036695, with English translation. (12 pages).

(Continued)

*Primary Examiner* — Kenneth Bomberg
*Assistant Examiner* — Adam W Brown
(74) *Attorney, Agent, or Firm* — Westerman, Hattori, Daniels & Adrian, LLP

(57) ABSTRACT

An impeller back surface cooling structure for cooling a back surface of a compressor impeller of a supercharger includes: a first member facing a back surface of a compressor impeller via a gap; and a second member extending in a circumferential direction of the compressor impeller and
(Continued)

forming, between the first member and the second member, a cooling passage through which a cooling medium being a liquid flows.

15 Claims, 9 Drawing Sheets

(51) Int. Cl.

| | |
|---|---|
| ***F02B 39/16*** | (2006.01) |
| ***F01D 25/12*** | (2006.01) |
| ***F02B 39/14*** | (2006.01) |
| ***F04D 29/44*** | (2006.01) |
| ***F04D 29/42*** | (2006.01) |

(52) U.S. Cl.
CPC ..... *F02B 39/14* (2013.01); *F02B 39/16* (2013.01); *F04D 29/4206* (2013.01); *F04D 29/441* (2013.01); *F04D 29/5853* (2013.01)

(58) Field of Classification Search
CPC ..... F02B 39/16; F02B 39/00; F02B 39/14; F01D 25/12
See application file for complete search history.

(56) References Cited

U.S. PATENT DOCUMENTS

| | | | | |
|---|---|---|---|---|
| 2,322,824 | A * | 6/1943 | Buchi | F02C 6/12 417/373 |
| 2,480,095 | A * | 8/1949 | Buchi | F01D 5/04 417/406 |
| 2,830,755 | A * | 4/1958 | Anderson | F04D 29/063 415/175 |
| 4,157,834 | A * | 6/1979 | Burdette | F01D 11/003 277/306 |
| 6,206,639 | B1 * | 3/2001 | Light | F16D 13/72 192/113.24 |
| 6,238,179 | B1 | 5/2001 | Wunderwald et al. | |
| 7,367,190 | B2 | 5/2008 | Shibui et al. | |
| 7,530,230 | B2 | 5/2009 | Shibui et al. | |
| 8,169,110 | B2 * | 5/2012 | Swales | H02K 11/048 310/54 |
| 10,072,667 | B2 | 9/2018 | An et al. | |

FOREIGN PATENT DOCUMENTS

| | | | |
|---|---|---|---|
| CN | 104736814 | A | 6/2015 |
| CN | 104903586 | A | 9/2015 |
| DE | 202013100884 | U1 | 3/2013 |
| EP | 0961034 | B1 | 9/2003 |
| EP | 1749991 | A2 | 2/2007 |
| EP | 1752636 | A2 | 2/2007 |
| EP | 2 930 370 | A1 | 10/2015 |
| EP | 3214287 | A1 | 9/2017 |
| GB | 1 436 347 | A | 5/1976 |
| JP | H07-97930 | A | 4/1995 |
| JP | 2003-525377 | A | 8/2003 |
| JP | 3606293 | B2 | 1/2005 |
| JP | 2011-256832 | A | 12/2011 |
| JP | 2013-130086 | A | 7/2013 |
| WO | 01/29426 | A1 | 4/2001 |
| WO | 2016/067715 | A1 | 5/2016 |

OTHER PUBLICATIONS

International Search Report dated Apr. 11, 2017, issued in International Application No. PCT/JP2017/001484, with Englis translation of IPRP. (12 pages).
Office Action dated Aug. 4, 2017, issued in counterpart Japanese Application No. 2016-031339, with English machine translation. (7 pages).
Extended (supplementary) European Search Report dated Mar. 27, 2018, issued in counterpart European Application No. 17756023.2. (7 pages).
Office Action dated Jan. 23, 2019, issued in counterpart EP Application No. 17756023.2 (4 pages).
Office Action dated Jul. 16, 2019, issued in counterpart CN application No. 201780002542.4, with English translation. (9 pages).

* cited by examiner

IMPELLER BACK SURFACE COOLING STRUCTURE AND SUPERCHARGER

TECHNICAL FIELD

The present invention relates to an impeller back surface cooling structure and a supercharger.

BACKGROUND ART

A supercharger is widely used as an auxiliary device for obtaining high combustion energy in an internal combustion engine. For instance, an exhaust turbine type supercharger is configured to rotate a turbine rotor with exhaust gas of an internal combustion engine and rotate a compressor impeller with the motoring force of the turbine rotor, and thereby to compress air to be supplied to the internal combustion engine.

Furthermore, a known technique for extending the lifetime of a compressor impeller of a supercharger is to spray cooling air to the back surface of the compressor impeller to cool the back surface of the compressor impeller. In this method, cooling air bypassed from a scavenging pipe (supply air pipe) of an internal combustion engine is utilized, and thus the temperature of the cooling air is limited. Also, cooling air is directly sprayed to the back surface of the compressor impeller, and thus the thrust force of the compressor impeller is increased.

Patent Document 1 discloses a supercharger for solving the above problems. In Patent Document 1, the supercharger has a hollow section inside a compressor-side housing which is a part of a bearing pedestal and which includes a wall portion facing a compressor impeller. Further, lubricant oil is sprayed into the hollow section toward the wall portion from an injection nozzle disposed on the compressor-side housing, and thereby the wall portion is cooled by the lubricant oil. Thus, the high-temperature air between the wall portion and the compressor impeller is cooled, whereby it is possible to cool the compressor impeller with the cooled air.

With the above configuration, it is possible to cool the compressor impeller without spraying the cooling air to the compressor impeller, and thus to suppress an increase in the thrust force of the compressor impeller.

CITATION LIST

Patent Literature

Patent Document 1: JP3606293B

SUMMARY

Problems to be Solved

In the supercharger disclosed in Patent Document 1, since the compressor-side housing having a hollow section is made of a single member, it is difficult to form the hollow section by a method other than casting, and thus the hollow section tends to be limited in terms of production. Thus, it is difficult to provide the hollow section with a structure for cooling the back surface of the compressor impeller efficiently, and thus the effect to extend the lifetime of the compressor impeller tends to be limited.

The present invention was made in view of the above problem, and an object is to provide an impeller back surface cooling structure capable of cooling the back surface of a compressor impeller efficiently to extend the lifetime of the compressor impeller, and a supercharger having the impeller back surface cooling structure.

Solution to the Problems (1) An impeller back surface cooling structure according to at least one embodiment of the present invention, for cooling a back surface of a compressor impeller of a supercharger, comprises: a first member facing a back surface of the compressor impeller via a gap; and a second member forming, between the first member and the second member, a cooling passage (20) through which a cooling medium being a liquid flows.

With the above impeller back surface cooling structure described in the above (1), the first member is cooled by the liquid flowing through the cooling passage, and the cooled first member cools the air in the gap between the back surface of the compressor impeller and the first member. Thus, it is possible to cool the back surface of the compressor impeller with the cooled air in the gap.

Thus, it is possible to cool the back surface of the compressor impeller without spraying cooling air to the back surface of the compressor impeller, and thus it is possible to suppress an increase in the thrust force of the compressor impeller.

Furthermore, since the cooling passage is formed by two members, namely the first member and the second member, the cooling passage has less limitation in terms of production, as compared to a typical configuration (e.g. Patent Document 1) in which the cooling passage is formed as a hollow section inside a single member. Thus, it is possible to provide a structure such as a fin in the cooling passage, in order to cool the back surface of the compressor impeller efficiently. Accordingly, it is possible to cool the back surface of the compressor impeller efficiently, and to extend the lifetime of the compressor impeller.

(2) In some embodiments, in the impeller back surface cooling structure according to the above (1), the first member comprises at least one fin facing the cooling passage.

With the above impeller back surface cooling structure described in the above (2), the first member facing the back surface of the compressor impeller is efficiently cooled through heat exchange between the liquid flowing through the cooling passage and the fin of the first member. Thus, it is possible to cool the back surface of the compressor impeller efficiently via the air in the gap.

(3) In some embodiments, in the impeller back surface cooling structure according to the above (1), the second member comprises at least one fin facing the cooling passage.

With the above impeller back surface cooling structure described in the above (3), the second member is efficiently cooled through heat exchange between the liquid flowing through the cooling passage and the fin of the second member. Accordingly, it is also possible to cool the first member adjacent to the second member efficiently, and thus it is possible to cool the back surface of the compressor impeller efficiently via the air in the gap.

(4) In some embodiments, in the impeller back surface cooling structure according to the above (3), the first member includes a groove portion on a surface opposite to the compressor impeller, the second member includes a lid portion covering the groove portion, the cooling passage is formed by the groove portion and the lid portion, and the at least one fin is disposed on the lid portion so as to protrude toward the lid portion.

With the above impeller back surface cooling structure described in the above (4), among the groove portion and the lid portion constituting the cooling passage, the lid portion includes the fin, and thus the fin can be produced more easily than in a case where the fin is disposed inside the groove portion. For instance, the second member can be produced easily by joining the fins to a flat portion by welding or the like.

(5) In some embodiments, in the impeller back surface cooling structure according to any one of the above (2) to (4), the first member, the second member, the groove portion, and the at least one fin are each formed to have an annular shape around a rotational axis of the compressor impeller.

With the impeller back surface cooling structure described in the above (5), the annular fin efficiently cools the above member having the fin over a broad range in the circumferential direction of the compressor impeller. Thus, it is possible to cool the back surface of the compressor impeller efficiently.

(6) In the impeller back surface cooling structure according to the above (5), the at least one fin includes at least one opening portion penetrating in a radial direction of the compressor impeller.

With the above impeller back surface cooling structure described in the above (6), the liquid flowing through the cooling passage can transfer from the radially inner side to the radially outer side (or in inverse direction) of the annular fin through the opening portion, and thereby it is possible to distribute the liquid uniformly to both of the radially inner side and the radially outer side of the annular fin. Accordingly, it is possible to cool the first member and the second member efficiently, and thus it is possible to cool the back surface of the compressor impeller efficiently via the air in the gap.

(7) In some embodiments, in the impeller back surface cooling structure according to the above (6), the at least one fin comprises a plurality of annular fins arranged in the radial direction of the compressor impeller. Each of the plurality of annular fins has at least one opening portion penetrating in the radial direction of the compressor impeller. The respective opening portions of the plurality of annular fins are arranged in a line along the radial direction of the compressor impeller.

With the above impeller back surface cooling structure described in the above (7), the member with the fin (first member or second member) is efficiently cooled through heat exchange between the liquid in the cooling passage and the plurality of fins. Furthermore, also in a case where the plurality of fins are provided, it is possible to distribute the liquid in the cooling passage uniformly to both of the radially inner side and the radially outer side of the annular fin, via the opening portions disposed in a line along the radial direction. Accordingly, it is possible to cool the first member and the second member efficiently, and thus it is possible to cool the back surface of the compressor impeller efficiently via the air in the gap.

(8) In some embodiments, in the impeller back surface cooling structure according to any one of the above (1) to (7), the first member or the second member includes a supply opening for supplying the cooling passage with the liquid, the first member or the second member includes a discharge opening for discharging the liquid from the cooling passage, the supply opening is disposed above a rotational axis of the compressor impeller, and the discharge opening is disposed above the rotational axis of the compressor impeller and opposite to the supply opening across a vertical plane including the rotational axis of the compressor impeller.

With the impeller back surface cooling structure described in the above (8), the liquid in the cooling passage is discharged from the discharge opening only when the liquid has accumulated to the height position of the discharge opening (above the rotational axis of the compressor impeller). Furthermore, the liquid supplied from the supply opening basically flows in a single direction along the circumferential direction (direction from the supply opening toward the discharge opening via the bottom portion of the cooling passage), and thus the above configuration suppresses formation of a stagnation region of the liquid inside the cooling passage.

Thus, in operation of the supercharger, it is possible to let the liquid flow smoothly over a wide range in the circumferential direction, from the supply opening to the discharge opening, in a state where the liquid has accumulated at least to the height position of the discharge opening in the cooling passage. Accordingly, it is possible to cool the first member and the second member efficiently, and thus it is possible to cool the back surface of the compressor impeller efficiently.

(9) In some embodiments, in the impeller back surface cooling structure according to the above (8), the first member or the second member includes, at a position closer to a top portion of the cooling passage than the supply opening and closer to the top portion than the discharge opening in a circumferential direction of the compressor impeller, a partition portion extending along the radial direction of the compressor impeller so as to partition the cooling passage.

With the above impeller back surface cooling structure described in the above (9), even when the liquid has accumulated to the top portion of the cooling passage, the partition portion can prevent formation of a flow directed from the supply opening toward the discharge opening via the top portion, and thus it is possible to limit the flow direction of liquid supplied from the supply opening to a single direction along the circumferential direction (direction from the supply opening toward the discharge opening via the bottom portion of the cooling passage).

Thus, in operation of the supercharger, it is possible to let the liquid flow smoothly over a wide range in the circumferential direction, from the supply opening to the discharge opening, even in a state where the liquid has accumulated to the top portion of the cooling passage. Accordingly, it is possible to cool the first member and the second member efficiently, and thus it is possible to cool the back surface of the compressor impeller efficiently via the air in the gap.

(10) In some embodiments, in the impeller back surface cooling structure according to any one of the above (1) to (9), the liquid flowing through the cooling passage is oil.

With the above impeller back surface cooling structure described in the above (10), it is possible to use a common supply system for both of the liquid to be sent to the cooling passage and the lubricant oil to be used in the above described bearing device. Accordingly, it is possible to cool the back surface of the compressor impeller efficiently with a simple configuration.

(11) A supercharger according to at least one embodiment of the present invention comprises: a compressor impeller; and the impeller back surface cooling structure according to any one of the above (1) to (10).

The supercharger described in the above (11) includes the impeller back surface cooling structure described in any one of the above (1) to (10), and thereby it is possible to cool the back surface of the compressor impeller efficiently, and to extend the lifetime of the compressor impeller and the supercharger.

Advantageous Effects

According to at least one embodiment of the present invention, provided is an impeller back surface cooling structure capable of cooling the back surface of a compressor impeller efficiently to extend the lifetime of the compressor impeller, and a supercharger having the impeller back surface cooling structure.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
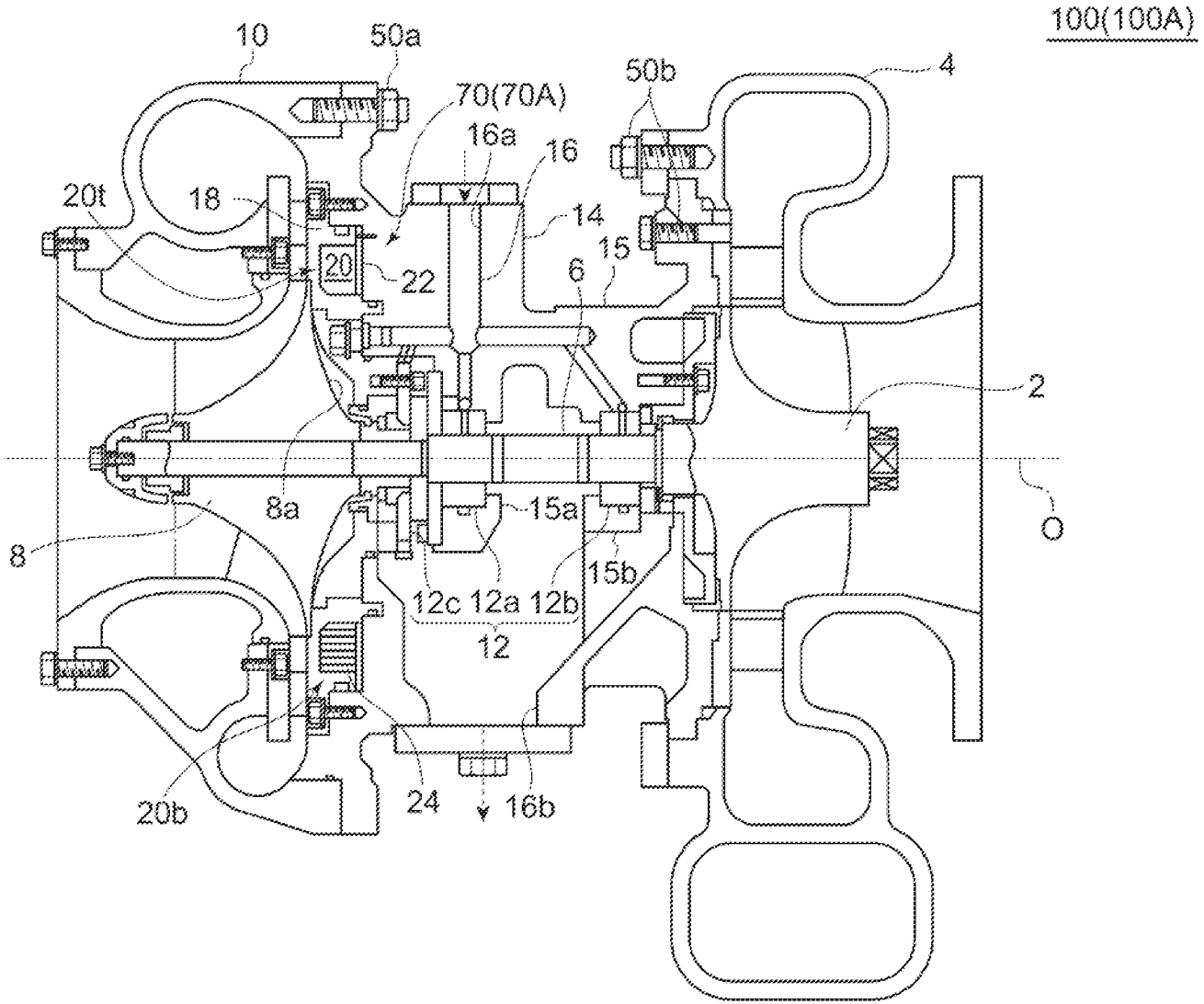
FIG. 1 is a schematic cross-sectional diagram illustrating an overall configuration of a supercharger (100) according to an embodiment.

FIG. 1 is a schematic cross-sectional diagram illustrating an overall configuration of a supercharger (100) according to an embodiment.

The supercharger 100 is an exhaust turbine type supercharger (turbocharger). The supercharger (turbocharger) 100 includes a turbine rotor 2, a turbine casing 4 housing the turbine rotor 2, a compressor impeller 8 coupled to the turbine rotor 2 via a shaft 6, a compressor casing 10 housing the compressor impeller 8, a bearing device 12 supporting the shaft 6, and a bearing pedestal 14 housing the bearing device 12.

In the following description, the direction of the rotational axis O of the shaft 6 (direction of the rotational axis O of the turbine rotor 2 and the compressor impeller 8) is simply referred to as "axial direction", and the radial direction of the shaft 6 (radial direction of the turbine rotor 2 and the compressor impeller 8) is simply referred to as "radial direction".

As shown in FIG. 1, the bearing device 12 includes journal bearings 12*a*, 12*b* and a thrust bearing 12*c*. Furthermore, a lubricant oil supply passage 16 for supplying lubricant oil to the journal bearings 12*a*, 12*b* and the thrust bearing 12*c* are formed inside the bearing pedestal 14. Lubricant oil supplied from a pump (not shown) flows into the lubricant oil supply passage 16 from an inlet 16*a* of the lubricant oil supply passage 16, passes through the journal bearings 12*a*, 12*b* or the thrust bearing 12*c*, and is discharged from the outlet 16*b* of the lubricant oil supply passage 16. The journal bearings 12*a*, 12*b* are supported by bearing mount portions 15*a*, 15*b* of the bearing pedestal body 15, respectively.

Figure 2:
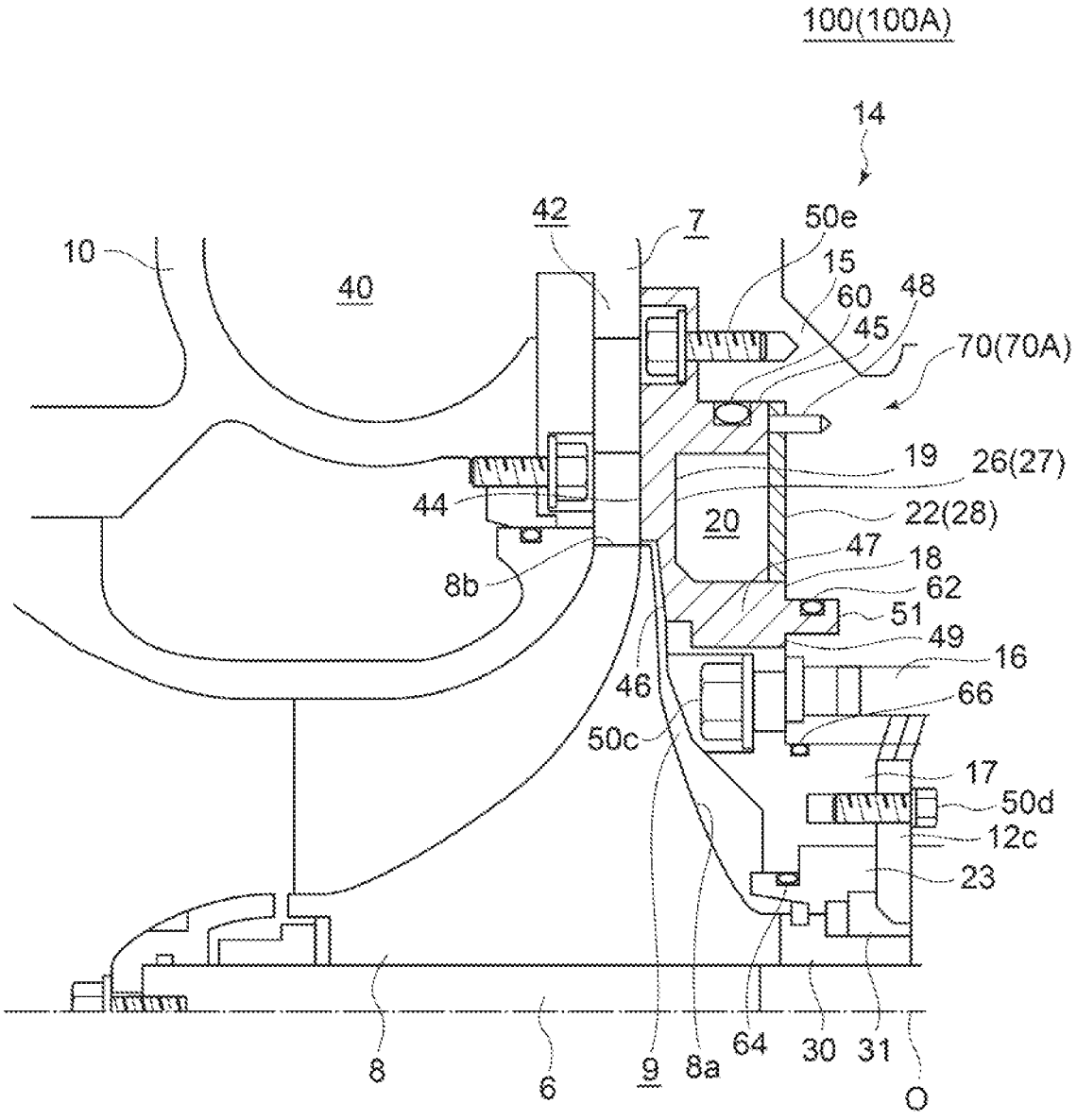
FIG. 2 is a partial enlarged view taken in the vicinity of the back surface of a compressor impeller 8 of the supercharger 100 (100A).

FIG. 2 is a partial enlarged view taken in the vicinity of the back surface of the compressor impeller 8 in FIG. 1.

As shown in at least one of FIG. 1 or FIG. 2, the bearing pedestal 14 includes a bearing pedestal body 15, an oil labyrinth 23, an inner support 17 (bearing support), an outer support 18, and a lid member 22. In the embodiment shown in FIGS. 1 and 2, the outer support 18 (first member) and the lid member 22 (second member) constitute an impeller back surface cooling structure 70 (70A) for cooling the back surface 8*a* of the compressor impeller 8.

The bearing pedestal body 15 is fastened to the compressor casing 10 by a bolt 50*a* at a side in the axial direction, and is fastened to the turbine casing 4 by a bolt 50*b* at the other side in the axial direction.

The oil labyrinth 23 is formed to have an annular shape around the rotational axis O of the shaft 6 so as to surround a part of the sleeve 30 and the thrust collar 31 fixed to the shaft 6, and suppresses leakage of the lubricant oil toward the air passage 7 inside the compressor casing 10. The oil labyrinth 23 is disposed so as to face the back surface 8*a* of the compressor impeller 8 via a gap 9.

The inner support 17 is formed into an annular shape around the rotational axis O of the shaft 6 so as to be engaged with the outer peripheral surface of the oil labyrinth 23. The inner support 17 is disposed so as to face the back surface 8*a* of the compressor impeller 8 via the gap 9. The inner support 17 is fastened to the bearing pedestal body 15 by a bolt 50*c*. The inner support 17 and the thrust bearing 12*c* are fastened by a bolt 50*d*, and the thrust bearing 12*c* is supported by the inner support 17.

The outer support 18 is formed to have an annular shape around the rotational axis O of the shaft 6 so as to be engaged with the outer peripheral surface of the inner support 17. The outer support 18 includes a back-surface facing portion 46 facing the back surface 8*a* of the compressor impeller 8 via the gap 9, a diffuser wall portion 44 facing a diffuser flow passage 42 between an outlet 8*b* of the compressor impeller 8 and the scroll flow passage 40 of the compressor casing 10, and a groove portion 26 having an annular shape and extending around the rotational axis O of the shaft 6, on a surface 19 of the outer support 18, the surface 19 being disposed opposite to the compressor impeller 8 (surface of the outer support 18 opposite to the diffuser flow passage 42 in the axial direction). Furthermore, the outer support 18 includes an outer peripheral wall portion 45 formed to have an annular shape around the rotational axis O of the shaft 6, disposed on the radially outer side of the groove portion 26, an inner peripheral wall portion 47 formed to have an annular shape around the rotational axis O of the shaft 6, disposed on the radially inner side of the groove portion 26, and a protruding portion 51 protruding from a surface 49 of the inner peripheral wall portion 47, the surface 49 being disposed opposite to the compressor impeller 8. The outer support 18 is disposed on the outer side of the thrust bearing 12*c* with respect to the radial direction, and is fastened to the bearing pedestal body 15 by a bolt 50*e* on the outer side of the groove portion 26 in the radial direction. According to the above configuration, the outer support 18 and the inner support 17 are formed of separate members, and thus it is possible to remove only the inner support 17 from the bearing pedestal body 15 without removing the outer support 18 from the bearing pedestal body 15, on maintenance of the supercharger 100. Accordingly, it is possible to perform maintenance easily on the thrust bearing 12*c* or the like supported by the inner support 17.

The lid member 22 is formed to have an annular shape around the rotational axis O of the shaft 6 so as cover the groove portion 26. The lid member 22 has a lid portion 28 forming, between the lid portion 28 and the groove portion 26 of the outer support 18, a cooling passage 20 which has an annular shape and through which the lubricant oil flows. The lid member 22 is fixed to the bearing pedestal body 15 by a pin 48. The outer support 18 and the bearing pedestal body 15 are fastened by the bolt 50*e*, and thereby the lid member 22 is nipped and supported by the outer support 18 and the bearing pedestal body 15 in the axial direction. In the exemplary embodiment shown in the drawing, the cooling passage 20 is disposed on the outer side of the thrust bearing 12*c* and the bolt 50*c* with respect to the radial direction, and extends from a position on the inner side of the outlet 8*b* of the compressor impeller 8 (outer peripheral edge of the compressor impeller 8) to a position on the outer side of the outlet 8*b*.

In such a configuration, the outer support 18 is cooled by the lubricant oil flowing through the cooling passage 20, and the cooled outer support 18 cools air in the gap 9 between the back surface 8*a* of the compressor impeller 8 and the outer support 18. Thus, it is possible to cool the back surface 8*a* of the compressor impeller 8 with the cooled air in the gap 9.

Thus, it is possible to cool the back surface 8*a* of the compressor impeller 8 without spraying cooling air to the back surface 8*a* of the compressor impeller 8, and thus it is possible to suppress an increase in the thrust force of the compressor impeller 8.

Furthermore, since the cooling passage 20 is formed by two members, namely the outer support 18 and the lid member 22, the shape or the like of the cooling passage 20 has less limitation in terms of production, as compared to a typical configuration (e.g. Patent Document 1) in which the cooling passage is formed as a hollow section inside a single member. Thus, it is possible to provide a structure such as a fin or the like in the cooling passage 20 easily, in order to cool the back surface 8*a* of the compressor impeller 8 efficiently. Accordingly, it is possible to cool the back surface 8*a* of the compressor impeller 8 efficiently, and to extend the lifetime of the compressor impeller 8.

In the embodiment shown in FIG. 2, O rings 60, 62 are disposed so as to be nipped and supported between the outer support 18 and the bearing pedestal body 15, so that lubricant oil flowing through the cooling passage 20 does not leak toward the air passage 7 inside the compressor casing 10. In the embodiment shown in the drawing, the O ring 60 is disposed in a seal groove formed on the outer peripheral surface of the outer wall portion 45, on the outer side of the groove portion 26 and on the inner side of the bolt 50*e* in the radial direction. The O ring 62 is disposed in a seal groove formed on the outer peripheral surface of the protruding portion 51, on the inner side of the groove portion 26 and on the outer side of the bolt 50*c* in the radial direction. Furthermore, in the embodiment shown in the drawing, O rings 64, 66 are disposed between the oil labyrinth 23 and the inner support 17 and between the inner support 17 and the bearing pedestal body 15, so that lubricant oil supplied to the thrust bearing 12*c* does not leak toward the air passage 7 inside the compressor casing 10.

In the embodiment shown in FIG. 2, lubricant oil to be supplied to the bearing device 12 is used as a cooling medium flowing through the cooling passage 20. In this case, it is possible to divert the lubricant oil for a bearing of the supercharger 100 into the cooling use, and thus provision of another cooling medium is not required. Furthermore, it is sufficient if only a related range of the supercharger 100 is modified (design modification), and thus modification (design modification) can be simplified. Thus, in a case where the supercharger 100 is installed on a ship, for instance, it is unnecessary to connect pipes or the like for the cooling medium from the ship to the supercharger 100.

Figure 3:
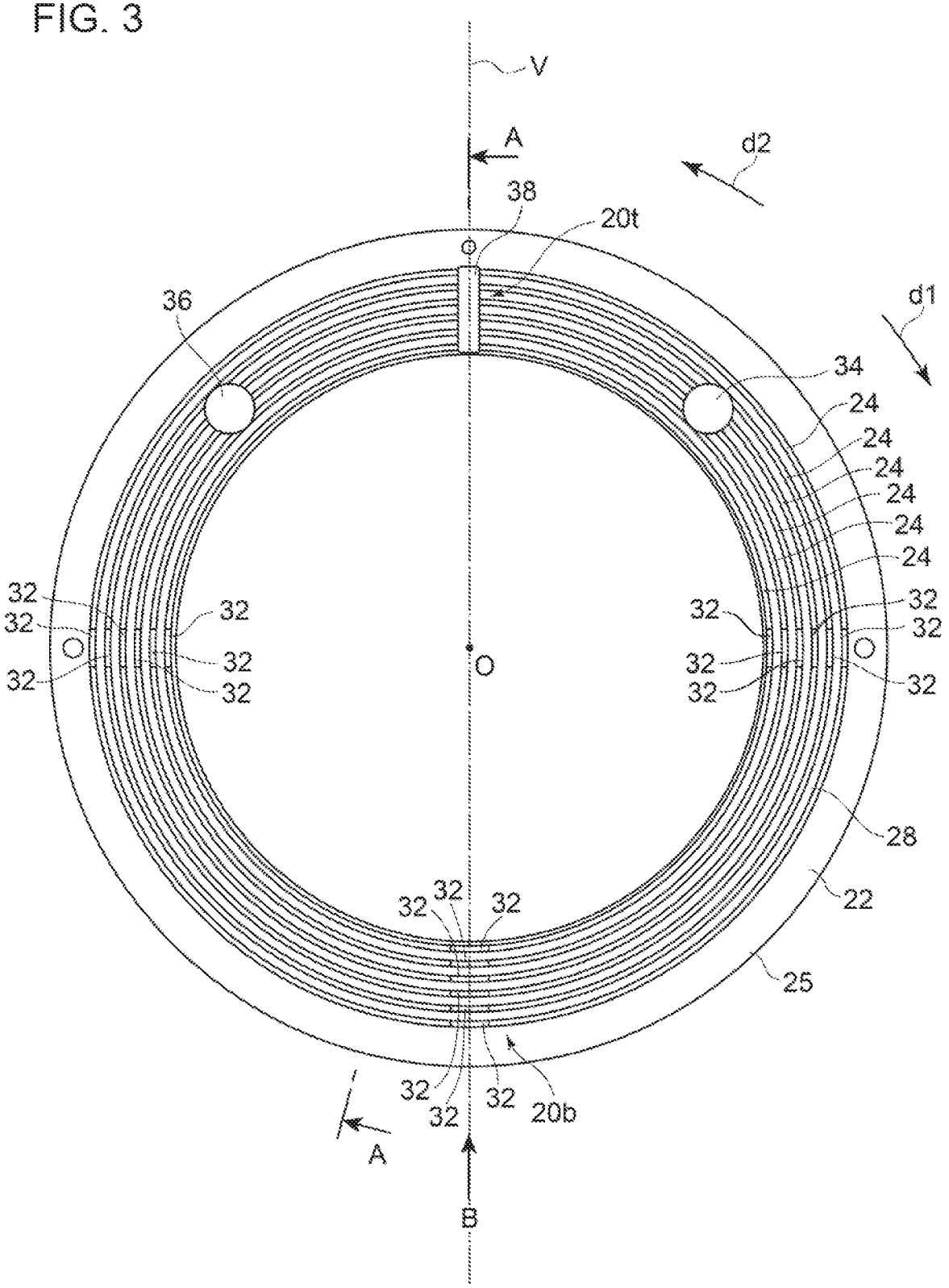
FIG. 3 is a view of a lid member 22 of the supercharger 100 (100A), as seen in a direction along the rotational axis O of the compressor impeller 8.
Figure 4:
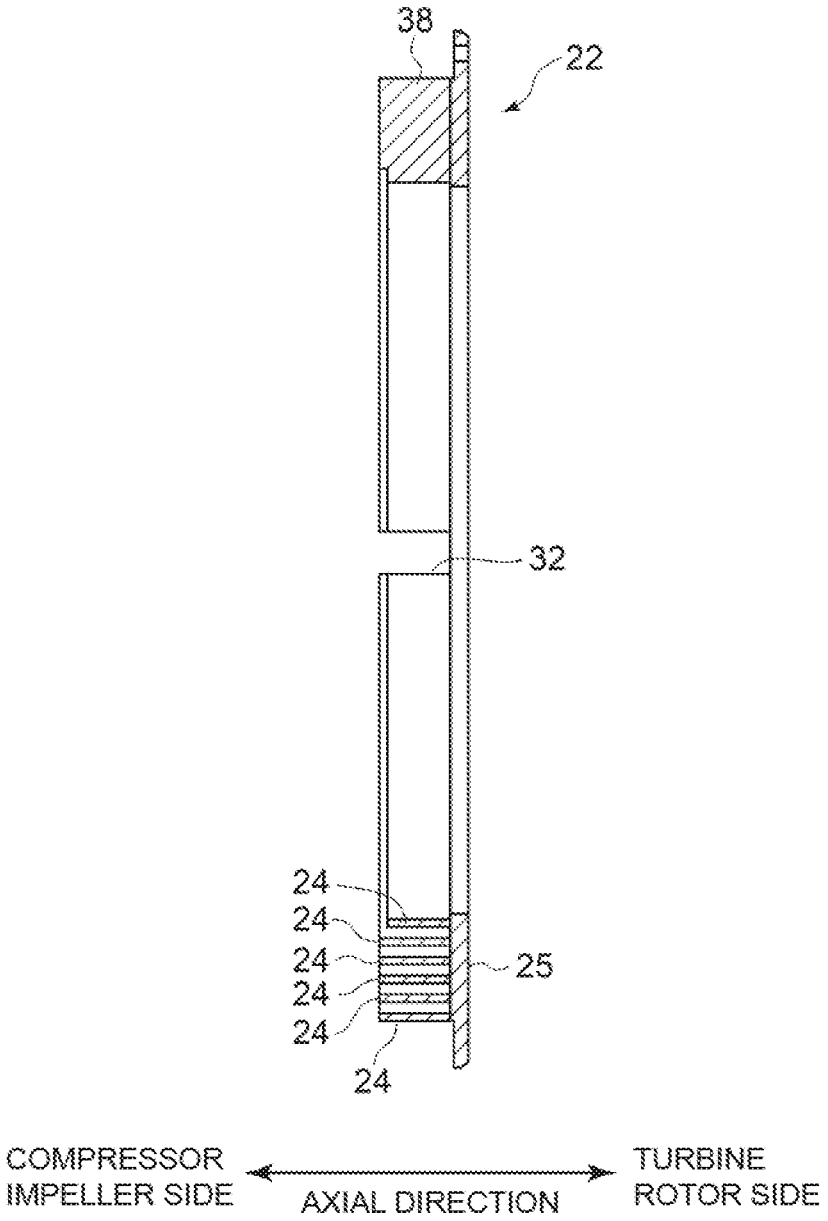
FIG. 4 is a diagram showing an example of a A-A cross section of the lid member 22 shown in FIG. 3.
Figure 5:
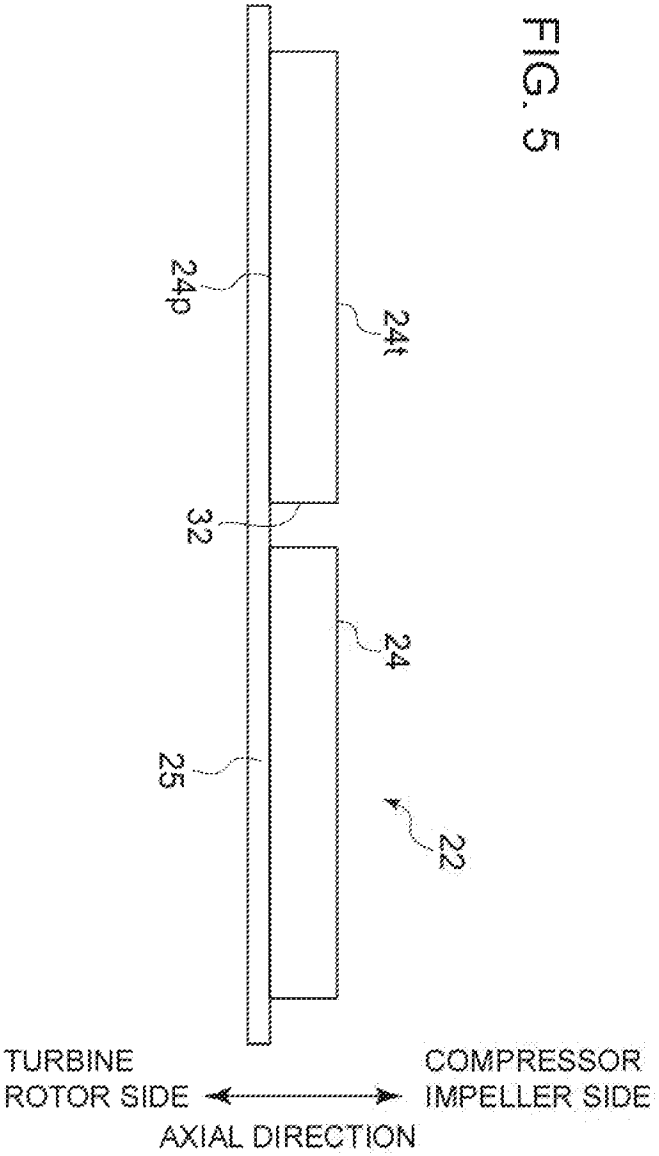
FIG. 5 is a view of the lid member 22 shown in FIG. 3, as seen in direction B.

FIG. 3 is a view of the lid member 22 in FIG. 2, as seen in a direction along the rotational axis O of the compressor impeller 8. FIG. 4 is a A-A cross-sectional view of the lid member 22 shown in FIG. 3. FIG. 5 is a view of the lid member 22 shown in FIG. 3, as seen in direction B.

In an embodiment, as shown in FIGS. 1 and 3 to 5, the lid member 22 includes a plurality of fins 24 facing the cooling passage 20. Each of the fins 24 is disposed on the lid portion 28 so as to protrude toward the compressor impeller 8 along the axial direction.

With the above configuration, the lid member 22 is efficiently cooled through heat exchange between the lid member 22 and the lubricant oil flowing through the cooling passage 20. Accordingly, it is also possible to cool the outer support 18 adjacent to the lid member 22 efficiently, and thus it is possible to cool the back surface 8*a* of the compressor impeller 8 with the air in the gap 9 cooled by the outer support 18.

Furthermore, the lid member 22 has the fins 24, and thus the fins 24 can be produced more easily than in a case where the fins 24 are disposed on the groove portion 26. For instance, the lid member 22 can be produced easily by joining the fins 24 to a smooth annular portion 25 by welding or the like.

In an embodiment, as shown in FIG. 3 for instance, each of the plurality of fins 24 is an annular fin formed around the rotational axis O of the shaft 6. The plurality of fins 24 are arranged in the radial direction.

Accordingly, the lid member 22 is cooled efficiently over a wide range in the circumferential direction of the compressor impeller 8, and thus it is possible to cool the outer support 18 via the lid member 22 efficiently. Thus, it is possible to cool the back surface 8*a* of the compressor impeller 8 with the air in the gap 9 cooled by the outer support 18.

In an embodiment, as shown in FIGS. 3 to 5, each of the plurality of annular fins 24 includes a plurality of opening portions 32 penetrating in the radial direction of the compressor impeller 8. In an embodiment, the respective opening portions 32 of the plurality of annular fins 24 are arranged in a line along the radial direction of the compressor impeller 8. Further, in the embodiment shown in the drawing, provided that the vertically uppermost angular position is the angular position of zero degree about the rotational axis O, the plurality of annular fins 24 have respective opening portions 32 at the angular positions of 90, 180, and 270 degrees.

With the above configuration, the lubricant oil flowing through the cooling passage 20 can transfer from the radially inner side to the radially outer side (or in inverse direction) of the annular fins 24 through the opening portions 32, and thereby it is possible to distribute the lubricant oil uniformly to both of the radially inner side and the radially outer side of the annular fins 24. Accordingly, the outer support 18 and the lid member 22 are cooled efficiently, and thus it is possible to cool the back surface 8*a* of the compressor impeller 8 with the air in the gap 9 cooled by the outer support 18. Furthermore, the plurality of opening portions 32 are arranged in a line in the radial direction, and thus it is possible to enhance the effect to distribute the lubricant oil uniformly to both of the radially inner side and the radially outer side of the annular fins 24.

In an embodiment, as shown in FIG. 3, the lid member 22 includes a supply opening 34 for supplying lubricant oil to the cooling passage 20, and a discharge opening 36 for discharging lubricant oil from the cooling passage 20. Furthermore, the supply opening 34 is disposed above the rotational axis O of the compressor impeller 8, and the discharge opening 36 is disposed above the rotational axis O of the compressor impeller 8 and opposite to the supply opening 34 across the vertical plane V including the rotational axis O of the compressor impeller 8. In the depicted embodiment, the supply opening 34 and the discharge opening 36 are formed across at least a plurality of fins 24 (in the embodiment shown in the drawing, four fins 24 excluding the outermost fin 24 and the innermost fin 24). Herein, in a case where the supercharger 100 is installed on a ship, "above" refers to "above" in a state where the ship body is not tilted. That is, "above" refers to "above" with respect to the up-down direction orthogonal to the surface on which the supercharger 100 is installed.

With the above configuration, the lubricant oil of the cooling passage 20 is discharged from the discharge opening 36 only when the lubricant oil has accumulated to the height position of the discharge opening 36 (above the rotational axis O of the compressor impeller 8). Furthermore, the lubricant oil supplied to the cooling passage 20 from the supply opening 34 basically flows in a single direction along the circumferential direction (direction shown by arrow 'd1' in FIG. 3, that is, direction from the supply opening 34 toward the discharge opening 36 via the bottom portion 20*b* of the cooling passage 20), and thus the above configuration suppresses formation of a stagnation region of lubricant oil inside the cooling passage 20.

Thus, in operation of the supercharger 100, it is possible to let the lubricant oil flow smoothly over a wide range in the circumferential direction, from the supply opening 34 to the discharge opening 36 as shown by arrow 'd1', in a state where the lubricant oil has accumulated at least to the height position of the discharge opening 36 in the cooling passage 20. Accordingly, the outer support 18 and the lid member 22 are cooled efficiently, and thus it is possible to cool the back surface 8*a* of the compressor impeller 8 effectively.

In an embodiment, as shown in FIG. 3, the lid member 22 includes a partition portion 38. The partition portion 38 extends, at a position closer to the top portion 20*t* of the cooling passage 20 than the supply opening 34 and closer to the top portion 20*t* than the discharge opening 36 with respect to the circumferential direction of the compressor impeller 8, along the radial direction of the compressor impeller 8, so as to partition the cooling passage 20. In an embodiment, the partition portion 38 is disposed on the top portion of the cooling passage 20.

With the above configuration, even when the lubricant oil has accumulated to the top portion 20*t* of the cooling passage, the partition portion 38 can prevent formation of a flow in the direction of arrow 'd2' in FIG. 3 (flow from the supply opening 34 toward the discharge opening 36 via the top portion 20*t*), and thus it is possible to limit the flow direction of lubricant oil supplied from the supply opening 34 to a single direction along the circumferential direction (the above direction 'd1').

Thus, in operation of the supercharger 100, it is possible to let the lubricant oil flow smoothly over a wide range in the circumferential direction, from the supply opening 34 to the discharge opening 36 as shown by arrow 'd1', even in a state where the lubricant oil has accumulated to the top portion 20*t* of the cooling passage. Accordingly, the outer support 18 and the lid member 22 are cooled efficiently, and thus it is possible to cool the back surface 8*a* of the compressor impeller 8 effectively.

The present invention is not limited to the embodiments described above, and various amendments and modifications may be implemented.

For instance, in the above embodiment, lubricant oil supplied to the bearing device 12 is shown as an example of a cooling medium that flows through the cooling passage 20. However, the cooling medium is not limited to the lubricant oil flowing through the cooling passage 20, and may be another cooling medium in a liquid state such as water. For instance, a part of jacket cooling water for cooling the internal combustion engine may be utilized as the cooling medium.

Furthermore, in the embodiment shown in FIGS. 3 to 5, the supply opening 34 and the discharge opening 36 are disposed on the lid member 22. However, either one, or both, of the supply opening 34 and the discharge opening 36 may be disposed on the outer support 18 forming the cooling passage 20 with the lid member 22.

Figure 6:
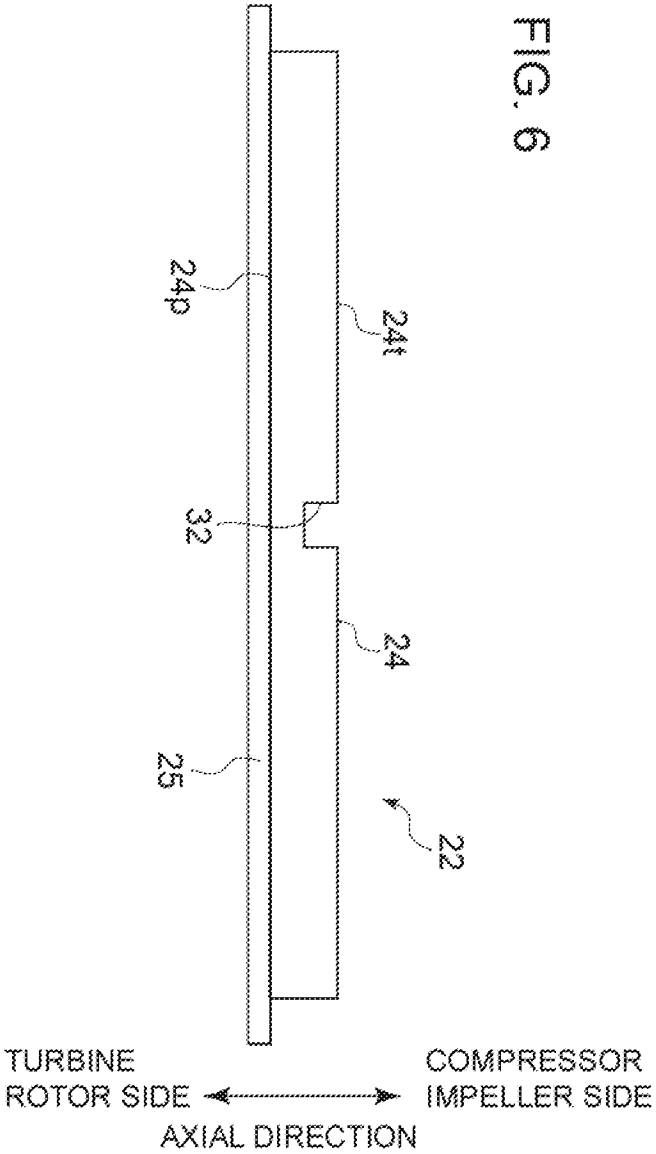
FIG. 6 is a diagram showing a modified example of the lid member 22.
Figure 7:
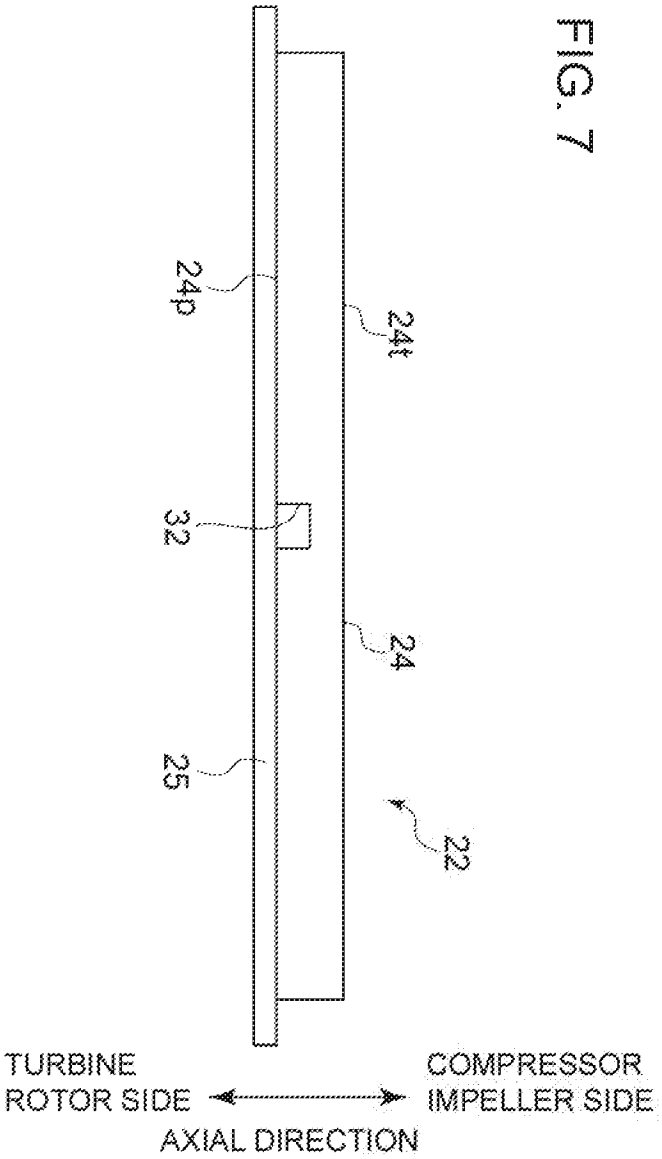
FIG. 7 is a diagram showing a modified example of the lid member 22.
Figure 8:
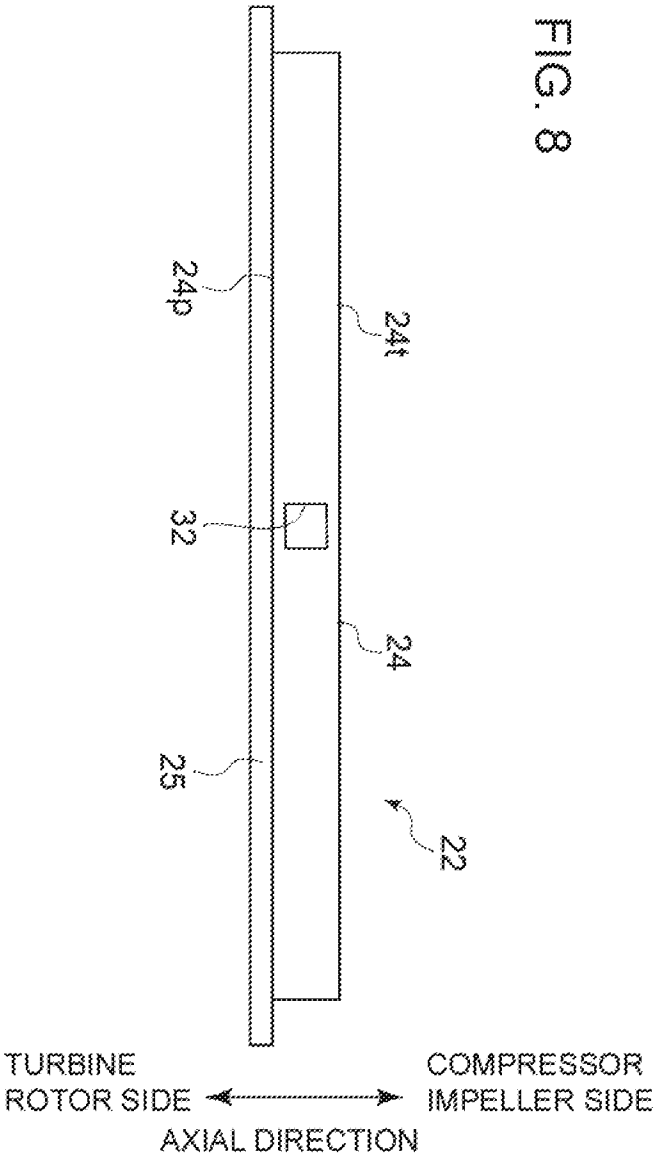
FIG. 8 is a diagram showing a modified example of the lid member 22.

Furthermore, in the embodiment shown in FIGS. 3 to 5, the opening portion 32 has an opening extending over the entire range from the root end 24*p* to the tip end 24*t* of the annular fin 24. However, the present invention is not limited to this embodiment. In some embodiments, as shown in FIGS. 6 to 8, the opening portion 32 may have an opening that extends only in a part of the range from the root end 24*p* to the tip end 24*t* of the annular fin 24. That is, the opening may extend partially on the side of the tip end 24*t* of the annular fin 24 as shown in FIG. 6, or partially on the side of the root end 24*p* of the annular fin 24 as shown in FIG. 7, or in an intermediate section between the root end 24*p* and the tip end 24*t* of the annular fin 24 as shown in FIG. 8.

For instance, in the above embodiment, the inner support 17 and the outer support 18 are formed separately (from separate members, i.e. from separate parts). In another embodiment, as shown in FIG. 9, the supercharger 100 may include an annular member 50 integrating the inner support 17 and the outer support 18 (formed as a single member, i.e. as a single part), instead of separate members.

Figure 9:
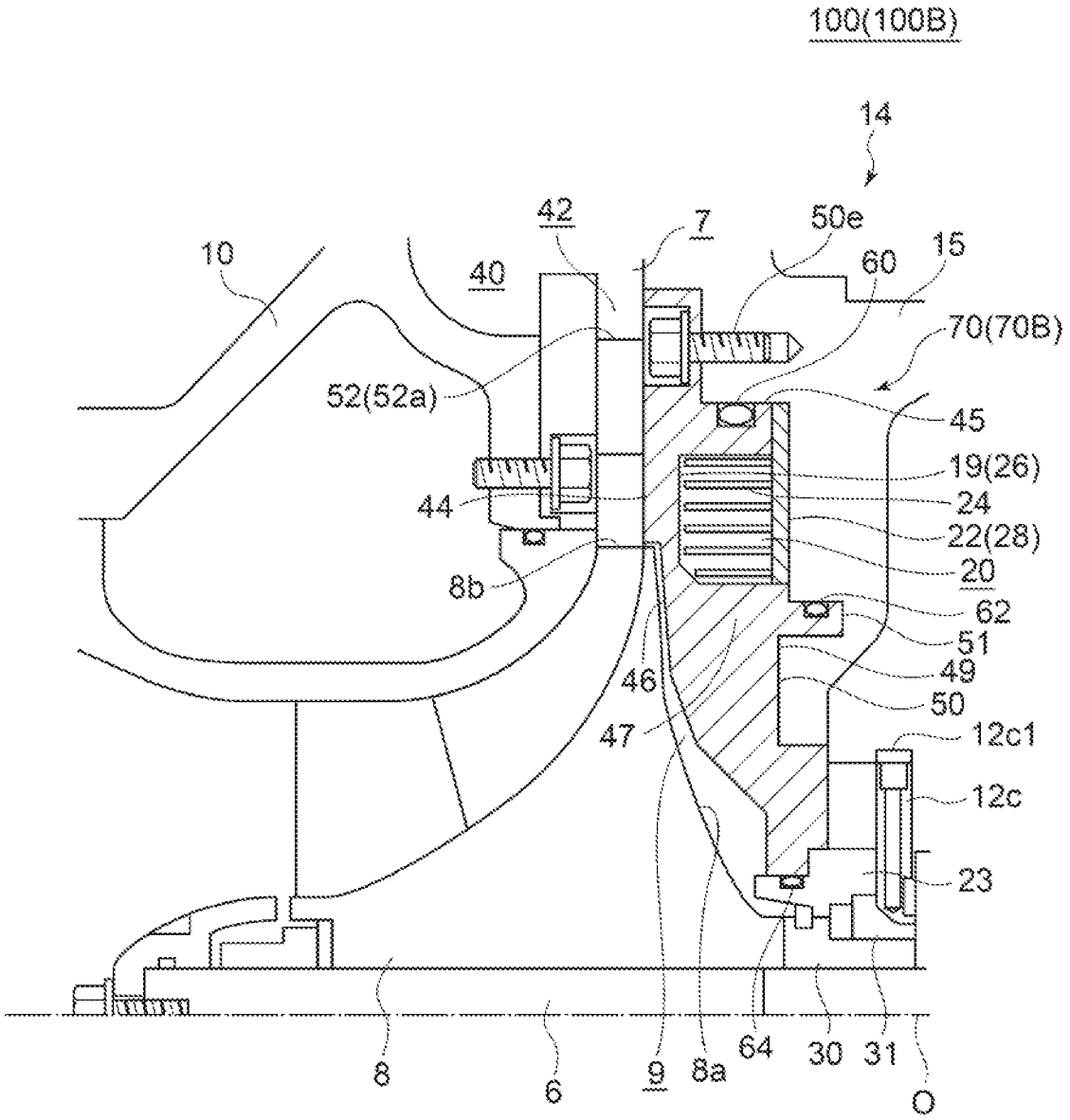
FIG. 9 is a partial enlarged view taken in the vicinity of the back surface of a compressor impeller 8 of a supercharger 100 (100B) according to another embodiment.

In the embodiment shown in FIG. 9, the annular member 50 is engaged with the outer peripheral surface of the oil labyrinth 23. The annular member 50 includes a back-surface facing portion 46 facing the back surface 8*a* of the compressor impeller 8 via a gap 9, a diffuser wall portion 44 facing the diffuser flow passage 42 between the outlet 8*b* of the compressor impeller 8 and the scroll flow passage 40 of the compressor casing 10, and a groove portion 26 having an annular shape and extending around the rotational axis O of the shaft 6, on the surface 19 disposed opposite to the compressor impeller 8. In this case, the supercharger 100 includes a member similar to the lid member 22 described above with reference to FIGS. 3 to 5. In the embodiment shown in FIG. 9, the annular member 50 (first member) and the lid member 22 (second member) form the impeller back surface cooling structure 70 (70B) for cooling the back surface 8*a* of the compressor impeller 8.

In the embodiment shown in FIG. 9, the annular member 50 is cooled by the lubricant oil flowing through the cooling passage 20 formed by the annular member 50 and the lid member 22, and the cooled annular member 50 cools air in the gap 9 between the back surface 8*a* of the compressor impeller 8 and the annular member 50. Thus, it is possible to cool the back surface 8*a* of the compressor impeller 8 with the cooled air in the gap 9, and extend the lifetime of the compressor impeller 8. Furthermore, the cooling passage 20 is formed on the annular member 50 integrating the inner support 17 and the outer support 18, and thus the annular member 50 with the cooling passage 20 formed thereon extends over a wide range in the radial direction, that is, in the embodiment shown in the drawing, from the inner side of the outer peripheral edge 12*c*1 of the thrust bearing 12*c* to the outer side of the outlet 8*b* of the compressor impeller 8 (outer side of the outer end 52*a* of the diffuser blade 52 disposed in the diffuser flow passage 42). Accordingly, it is possible to enhance the effect to cool the back surface 8*a* of the compressor impeller 8, as compared to the embodiment shown in FIG. 2.

In the embodiment shown in FIG. 9, instead of the inner support 17 and the outer support 18 shown in FIG. 2, the annular member 50 integrating the above supports is provided. Thus, there are fewer paths for lubricant oil to leak from the cooling passage 20 and the thrust bearing 12*c* toward the air passage 7 inside the compressor casing 10. Accordingly, it is possible to reduce the number of O rings (sealing members) for preventing leakage of lubricant oil.

Figure 10:
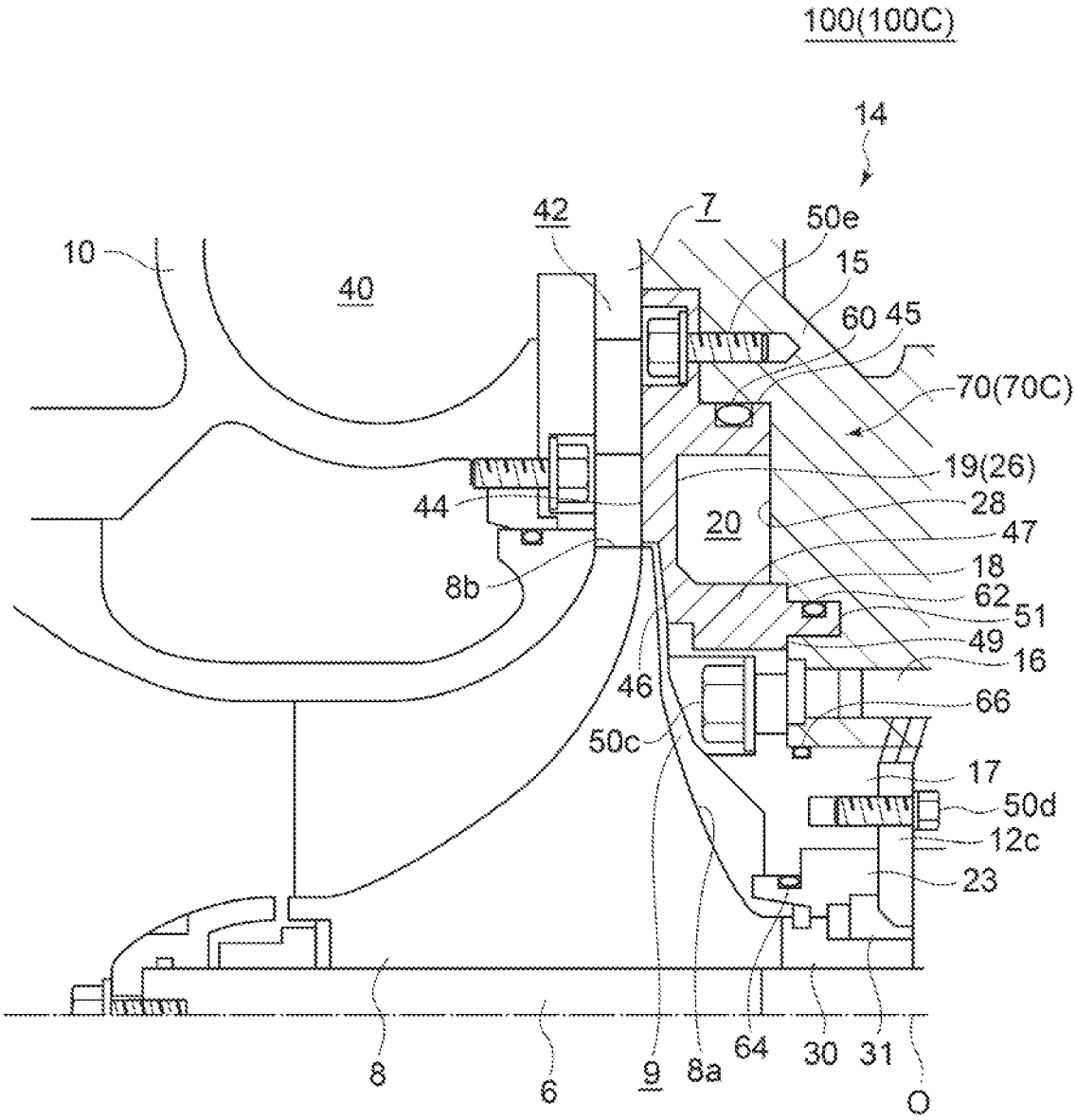
FIG. 10 is a partial enlarged view taken in the vicinity of the back surface of a compressor impeller 8 of a supercharger 100 (100C) according to yet another embodiment.

For instance, in the above embodiment shown in FIG. 2 for instance, the lid member 22 having the fin 24 and the bearing pedestal body 15 are formed separately (from separate members, i.e. separate parts). In another embodiment, as shown in FIG. 10, the supercharger 100 may include a bearing pedestal body 15 integrating the above parts. In the embodiment shown in FIG. 10, the outer support 18 (first member) and the bearing pedestal body 15 (second member) form the impeller back surface cooling structure 70 (70C) for cooling the back surface 8*a* of the compressor impeller 8.

In such an embodiment, the outer support 18 and the bearing pedestal body 15 form the cooling passage 20. Also with such an embodiment, it is possible to cool the back surface 8*a* of the compressor impeller 8, and extend the lifetime of the compressor impeller 8, similarly to the embodiment shown in FIG. 2.

Figure 11:
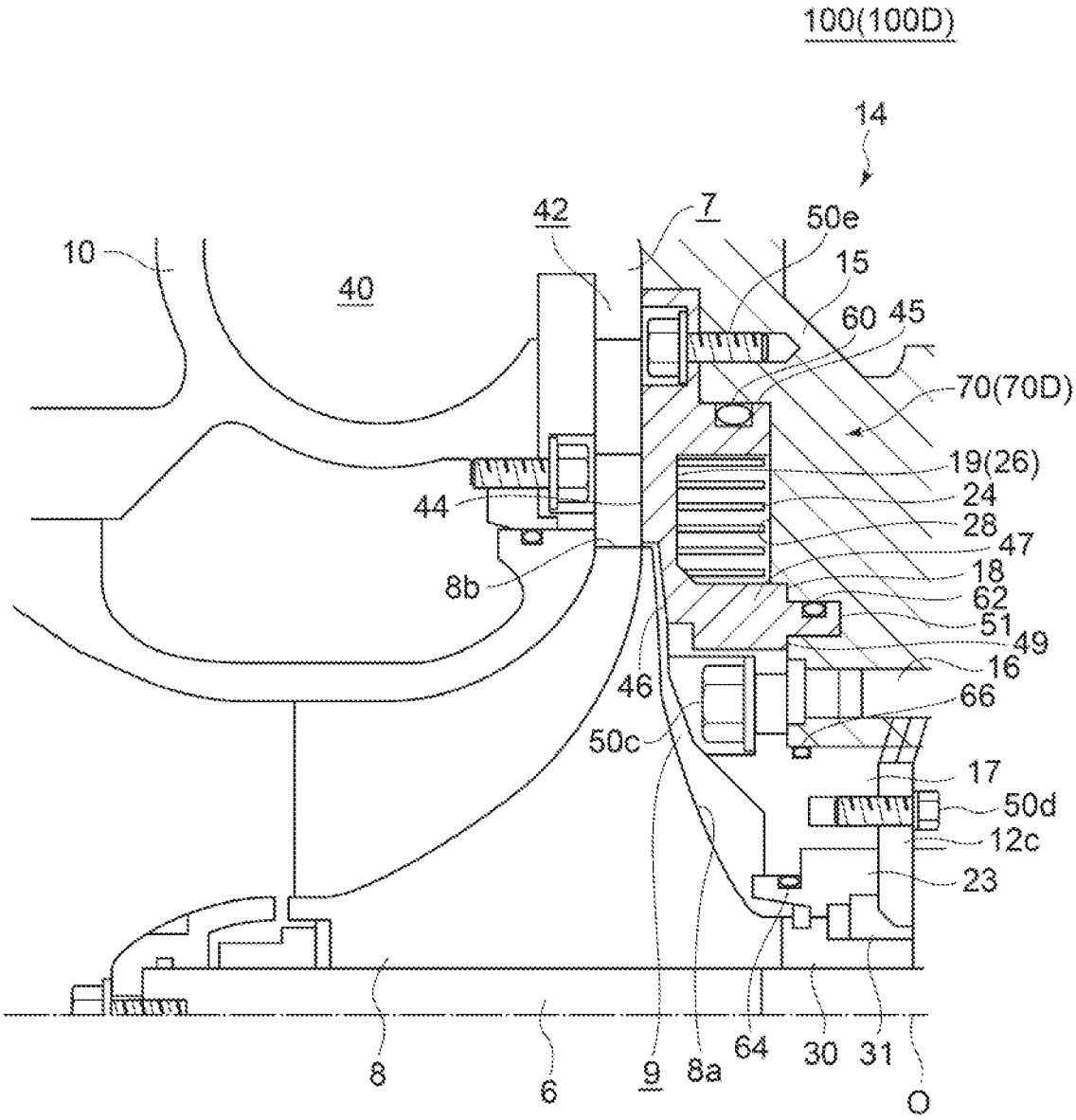
FIG. 11 is a partial enlarged view taken in the vicinity of the back surface of a compressor impeller 8 of a supercharger 100 (100D) according to yet another embodiment.

Furthermore, while the lid member 22 has the fins 24 in the embodiment shown in FIG. 2 or the like, the outer support 18 may have the fins 24 in another embodiment, as shown in FIG. 11. In the embodiment shown in FIG. 11, the outer support 18 (first member) and the bearing pedestal body 15 (second member) form the impeller back surface cooling structure 70 (70D) for cooling the back surface 8*a* of the compressor impeller 8. In the embodiment shown in FIG. 11, a plurality of fins 24 are disposed so as to protrude from the bottom surface 27 of the groove portion 26 of the outer support 18 (part of the above described surface 19) toward the turbine rotor 2 along the axial direction (in a direction away from the compressor impeller 8). Furthermore, the outer support 18 and the bearing pedestal body 15 form the cooling passage 20.

In such an embodiment, the outer support 18 facing the back surface 8*a* of the compressor impeller 8 has the fins 24, and thus the outer support 18 facing the back surface 8*a* of the compressor impeller 8 is cooled effectively through heat exchange between lubricant oil flowing through the cooling passage 20 and the fins 24. Thus, it is possible to cool the back surface 8*a* of the compressor impeller 8 effectively via the air in the gap 9.

Furthermore, application of the present invention is not limited to the above described exhaust turbine type supercharger (turbocharger). The present invention may be applied to a mechanical supercharger for driving a compressor with power extracted from an output shaft of an internal combustion engine via a belt or the like.

DESCRIPTION OF REFERENCE NUMERALS

2 Turbine rotor
Turbine casing
6 Shaft
8 Compressor impeller
8*a* Back surface
8*b* Outlet
9 Gap
10 Compressor casing
12 Bearing device
12*a*, 12*b* Journal bearing
12*c* Thrust bearing
12*c*1
14 Bearing pedestal
15 Bearing pedestal body
16 Lubricant oil supply passage
16*a* Inlet
16*b* Outlet
17 Inner support
18 Outer support
19 Surface
20 Cooling passage
20*b* Bottom portion
20*t* Top portion
22 Lid member
23 Oil labyrinth

24 Fin
24*p* Root end
24*t* Tip end
25 Annular portion
27 Bottom surface
28 Lid portion
30 Sleeve
31 Thrust collar
32 Opening portion
34 Supply opening
36 Discharge opening
38 Partition portion
40 Scroll flow passage
42 Diffuser flow passage
44 Diffuser wall portion
46 Back-surface facing portion
48 Pin
50*a*, 50*b*, 50*c*, 50*d*, 50*e* Bolt
52 Diffuser blade
52*a* Outer end
60, 60, 62, 62, 64, 66 O ring
100 Supercharger (turbocharger)
O Rotational axis
V Vertical plane
d1, d2 Arrow

The invention claimed is:

1. An impeller assembly, comprising:
a compressor impeller; and
an impeller back surface cooling structure, comprising:
a first member facing a back surface of the compressor impeller via a gap; and
a second member forming, between the first member and the second member, an annular cooling passage through which a cooling medium being a liquid flows,
wherein the annular cooling passage extends from a position on an inner side of an outlet of the compressor impeller to a position on an outer side of the outlet in a radial direction of the compressor impeller, the annular cooling passage having an annular shape in both inner side and outer side regions of the outlet of the compressor impeller.

2. The impeller assembly according to claim 1, wherein the first member comprises at least one fin facing the annular cooling passage.

3. The impeller assembly according to claim 1, wherein the second member comprises at least one fin facing the annular cooling passage.

4. The impeller assembly according to claim 1, wherein the liquid is oil.

5. A supercharger comprising the impeller assembly according to claim 1.

6. An impeller back surface cooling structure, comprising:
a first member facing a back surface of a compressor impeller via a gap; and
a second member forming, between the first member and the second member, a cooling passage through which a cooling medium being a liquid flows,
wherein the second member comprises at least one fin facing the cooling passage,
wherein the first member includes a groove portion on a surface opposite to the compressor impeller, wherein the second member includes a lid portion covering the groove portion,
wherein the cooling passage is formed by the groove portion and the lid portion, and
wherein the at least one fin is disposed on the lid portion.

7. The impeller back surface structure according to claim 6,
wherein the first member, the second member, the groove portion, and the at least one fin are each formed to have an annular shape around a rotational axis of the compressor impeller.

8. The impeller back surface structure according to claim 7,
wherein the at least one fin includes at least one opening portion penetrating in a radial direction of the compressor impeller.

9. The impeller back surface structure according to claim 8,
wherein the at least one fin comprises a plurality of annular fins arranged in the radial direction of the compressor impeller,
wherein each of the plurality of annular fins has at least one opening portion penetrating in the radial direction of the compressor impeller, and
wherein the respective opening portions of the plurality of annular fins are arranged in a line along the radial direction of the compressor impeller.

10. The impeller back surface structure according to claim 6, wherein the liquid is oil.

11. A supercharger comprising the impeller back surface cooling structure according to claim 6.

12. An impeller back surface cooling structure, comprising:
a first member facing a back surface of a compressor impeller via a gap; and
a second member forming, between the first member and the second member, a cooling passage through which a cooling medium being a liquid flows,
wherein the first member or the second member includes a supply opening for supplying the cooling passage with the liquid,
wherein the first member or the second member includes a discharge opening for discharging the liquid from the cooling passage,
wherein the supply opening is disposed above a rotational axis of the compressor
impeller, and
wherein the discharge opening is disposed above the rotational axis of the compressor impeller and opposite to the supply opening across a vertical plane including the rotational axis of the compressor impeller.

13. The impeller back surface structure according to claim 12,
wherein the first member or the second member includes, at a position closer to a top portion of the cooling passage than the supply opening and closer to the top portion than the discharge opening in a circumferential direction of the compressor impeller, a partition portion extending along the radial direction of the compressor impeller so as to partition the cooling passage.

14. The impeller back surface structure according to claim 12, wherein the liquid is oil.

15. A supercharger comprising the impeller back surface cooling structure according to claim 12.

* * * * *